US005813575A

United States Patent [19]

Glynn et al.

[11] Patent Number: 5,813,575

[45] Date of Patent: Sep. 29, 1998

[54] TOUCH FREE PUSH—PULL VALVE WITH OVERCAP

[75] Inventors: Kenneth P. Glynn, Township of Flemington, County of Hunterdon, N.J.; Stuart DeJonge, Township of Easton, County Northampton, Pa.

[73] Assignee: Ideal Ideas, Inc., Flemington, N.J.

[21] Appl. No.: 773,317

[22] Filed: Dec. 23, 1996

[51] Int. Cl.[6] ..... B67D 3/00

[52] U.S. Cl. ..... 222/182; 222/525; 220/256

[58] Field of Search ..... 222/182, 153.14, 222/525; 215/277; 220/255, 256, 714

[56] References Cited

U.S. PATENT DOCUMENTS

| | | | |
|---|---|---|---|
| 4,007,857 | 2/1977 | Tomiati et al. | 222/182 |
| 4,478,242 | 10/1984 | Bond . | |
| 4,776,501 | 10/1988 | Ostrosky . | |
| 5,022,562 | 6/1991 | Lurkis et al. | 220/256 |
| 5,230,447 | 7/1993 | Kirk . | |
| 5,429,255 | 7/1995 | Glynn . | |
| 5,431,305 | 7/1995 | Kaminski | 222/525 |
| 5,662,247 | 9/1997 | Rapchak et al. | 222/525 |

*Primary Examiner*—Philippe Derakshani
*Attorney, Agent, or Firm*—Kenneth P. Glynn

[57] ABSTRACT

A push-pull dispensing cap is described for a container having an open-necked top. There is a first cap member, attachable to an open-necked container, which has an outside thread for engagement with threading of an overcap, and has an upwardly projecting hollow portion with at least one dispensing port. It also is slideably attached to a second cap member such that the second cap member may cyclically moved with a first, closed position being downward, and a second, open position being upward. The second cap member has a dispensing port thereon and has an outwardly projecting ridge thereon with a cut-out located on the ridge to permit passage therethrough of a protrusion located inside the overcap. The second cap member is attached to the first cap member so as to prevent any of substantial horizontal rotation of it relative to the first cap member. The overcap is adapted to fit over the second cap member, has a top and a sidewall, has internal threading adapted to thread with the outside of the first cap member.

18 Claims, 2 Drawing Sheets

TOUCH FREE PUSH— PULL VALVE WITH OVERCAP

BACKGROUND OF THE INVENTION

1. Field of the Invention

The present invention relates to push-pull caps for liquid dispensing, especially the types used for chocolate syrups, maple syrups, ketchup, shampoo and the like. The present invention is directed to offering users of containers or dispensers with such push-pull caps the ability to utilize an overcap to open and close a push-pull cap without the need to actually touch the push-pull cap itself. This is achieved by modifications to both elements of conventional push-pull caps and to the overcap and eliminates having to actually touch messy push-pull caps that have historically had excess syrup remain after first usage.

2. Information Disclosure Statement

The following patents are representative of dispensing nozzles and caps such as push-pull caps.

U.S. Pat. No. 4,478,242 to Bond relates to a dispensing valve assembly comprising a slideable valve sleeve with a radially-directed dispensing outlet that is movable from a closed position axially within a guide portion to open position axially-outwardly of the guide portion. There are keying means between the guide portion and the valve sleeve ensures that the dispensing outlet is normally directed downwardly but this keying means is flexible and can be overcome to permit twisting of the valve sleeve in the guide portion to break a seal connected therebetween. Finger-engaging means are also provided to facilitate closing.

U.S. Pat. No. 4,776,501 to Ostrowsky relates to a press-to-open dispensing closure that is provided for the mouth of a container. It includes a closure body and a nozzle assembly carried by the closure body. The closure body has a deck extending across a portion of the container top, and the deck defines a port through which communication with the container interior is established. The nozzle assembly includes a forwardly projecting dispensing nozzle and rearwardly projecting actuating member above the deck. The nozzle assembly is pivotably supported in the closure body to accommodate pivoting movement between an open and a closed position. In one embodiment, spring members are provided on the closure body and project upwardly for resiliently biasing the nozzle assembly toward the closed position.

U.S. Pat. No. 5,230,447 to Kirk relates to a self-closing push-pull top for a bottle and includes a threaded collar adapted to engage a threaded bottle neck. A hollow stem extends from the threaded collar and engages a cylindrical guide aperture of a cap. The cap is slidable along the hollow stem about the guide aperture to a first position in which the hollow stem and the cap are positioned with respect to one another to prevent fluid flow from the bottle. The cap is further slidable along the hollow stem about the guide aperture to a second position in which the hollow stem and the cap are positioned to allow fluid flow therethrough. A biasing member is provided for biasing the cap on the first position. Since the cap is biased in this first position, it normally remains closed. Upon application of working pressure, the biasing member deforms to allow the cap to slide to the second position in which fluid may be dispensed for the bottle. Once the working pressure is removed, the biasing member urges the cap back to the first position thereby closing the top to prevent further fluid flow from the bottle.

U.S. Pat. No. 5,429,255 to Glynn relates to dispenser closures having a main closure base for attachment to a container, an outer ring and a push-pull dispenser mechanism attached to the base. The main closure base has a top portion with a circular horizontal track thereon for attachment with an outer ring and the outer ring has a corresponding circular inside wall horizontal track. They are connected so as to be freely horizontally rotatable thereabout, but otherwise permanently connected to one another. The outer ring has a top with an inwardly biased ledge for retaining a push-pull sleeve of the push-pull mechanism, and has a downwardly extended aspect to the ledge to retain the sleeve closed, and at least one cut out on the ledge to permit the sleeve to be pulled to an open position. The sleeve has a circular bottom for inserting into the outer ring and over a push-pull stem of the push-pull mechanism. The bottom of the sleeve has at least one protrusion with a geometry of adequate size to freely move up the cut out of the ledge of the outer ring when aligned therewith.

Notwithstanding the prior art, the present invention is neither taught nor rendered obvious thereby.

SUMMARY OF THE INVENTION

A push-pull dispensing cap is described for a container having an open-necked top. There is a first cap member, attachable to an open-necked container, which has an outside thread for engagement with threading of an overcap, and has an upwardly projecting hollow portion with at least one dispensing port. It also is slideably attached to a second cap member such that the second cap member may be cyclically moved upwardly and downwardly, with a first, closed position being downward, and a second, open position being upward. The second cap member has a dispensing port thereon and has an outwardly projecting ridge thereon with a cut-out located on the ridge to permit passage therethrough of a protrusion located inside an overcap. The second cap member is attached to said first cap member so as to prevent any of substantial horizontal rotation of it relative to the first cap member. The overcap is adapted to fit over the second cap member, has a top and a sidewall, has internal threading adapted to thread with the outside of the first cap member. Its internal protrusion on the inside of its sidewall, its threading and the first cap member threading are aligned relative to the cut-out of the second cap member, such that when the second cap is in the first closed position, the overcap may be screwed onto the threading of the first cap member whereby the protrusion will contact and flex past the ridge of the second cap member and will rest thereunder away from the cut-out of the second cap member, and such that when the second cap member is in the second, open position, the overcap may be screwed onto the threading of the first cap member, the protrusion pushes the second cap member from the second, open position to the first closed position, and such that when the overcap is already screwed onto the threading of the first cap member and the second cap member is in the first, closed position, and the overcap is unscrewed, the protrusion lifts the second cap member to the second, open position and then passes through the cut-out for removal. One alternative embodiment includes caps wherein the protrusion is on the second cap member and the ridge and cut-out are on the inside of the overcap. Another alternative has no cut-outs and the protrusion is flexible enough to pass by the ridge after lifting the second cap member to its second, open position.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
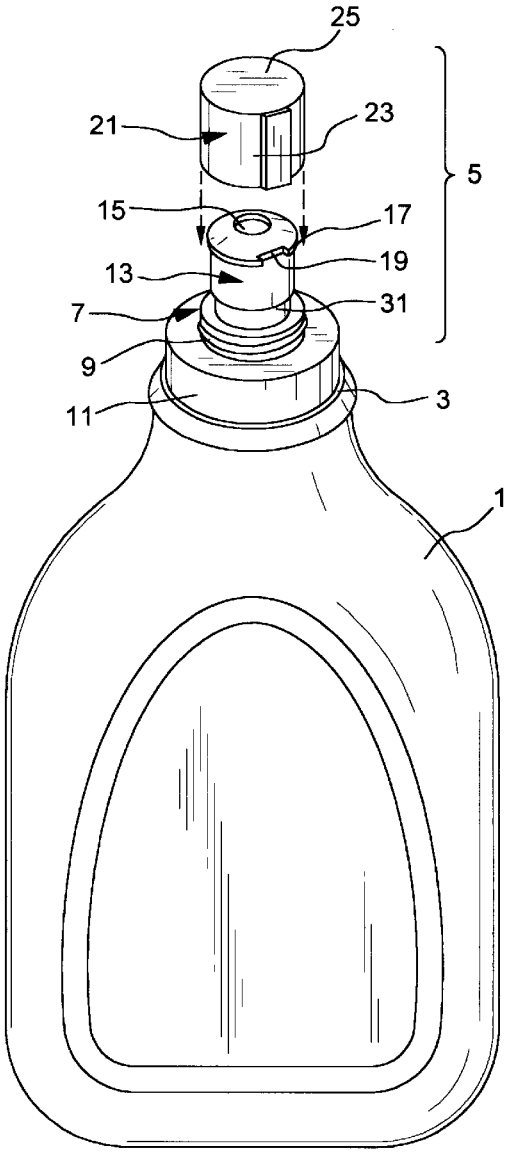
FIG. 1 illustrates a front oblique view of a present invention cap and container.

In FIG. 1 there is shown a front oblique view of a container 1 and a present invention cap shown generally as 5. Container 1 includes an open-necked top 3 which is adapted for attachment to a cap. In this case, the open-necked top 3 has a threaded neck (not shown). Present invention cap 5 includes a first cap member 7 which has threading inside of base 11 for attachment to container 1 and also includes outside threading 9 for engagement with inside threading of overcap 21. First cap member 7 also has an upwardly projecting hollow portion 31 which includes a dispensing port typically of push-pull dispensing caps. Second cap member 13 is slidably attached to upwardly projecting hollow portion 31 of first cap member 7 so that it may reciprocally or cyclically be moved upwardly and downwardly from a first, downward closed position to a second, upward open position. Second cap member 13 has vertical engagement with first cap member 7 so as to prevent significant rotation of second cap member 13 relative to first cap member 7. In preferred embodiments, this engagement is arranged so that little or no rotation between to two cap members can occur. This may be accomplished with vertical tracks or stops.

Second cap member 13 has a dispensing port 15 thereon which cooperates with the dispensing port of first cap member 7 such that when second cap member 13 is in the first, downward position it is closed, and when it is in the second, upward position, it is open.

Figure 2:
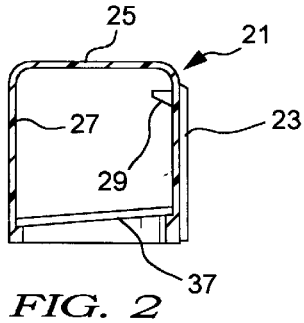
FIG. 2 illustrates a side cut view of the overcap shown in FIG. 1.

Second cap member 13 also has a ridge 17 and a cut-out 19 located on the ridge 17. Overcap 21 is adapted to cooperate with first cap member 7 and second cap member 13 so as to permit opening and closing of cap 5 without the user ever touching second cap member 13. Overcap 21 has a sidewall 23 and a top 25 as shown. Referring now to both FIGS. 1 and 2, it can be seen that overcap 21 has threading 37 which cooperates with external threading 9 of first cap member 7 and protrusion 29 cooperates with cut-out 19 of ridge 17.

Figure 3:
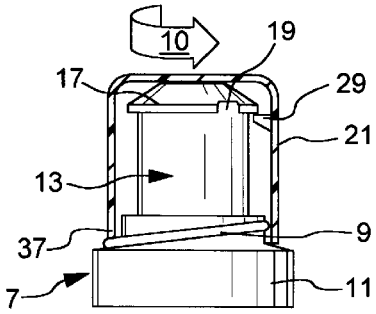
FIG. 3 shows a side, partially cut view of the present invention cap, including the threadable first cap member, the vertically moveable second cap member and the overcap in the closed position.
Figure 5:
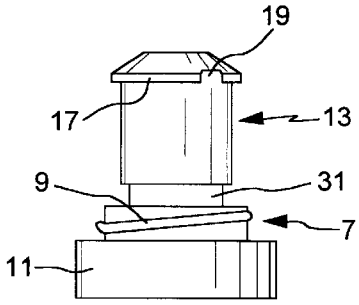
FIG. 5 shows a side view of the same cap as illustrated in FIG. 4 but with the overcap removed.
Figure 4:
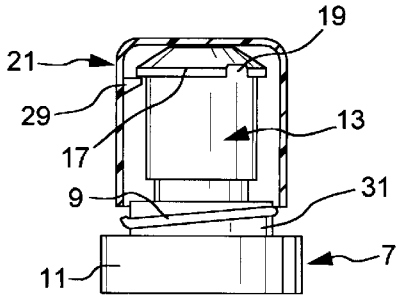
FIG. 4 illustrates a side, partially cut view of the present invention cap, including the threadable first cap member, with the second cap member being lifted to the open position by the overcap being unscrewed.

FIGS. 3, 4 and 5 illustrate further the functioning of the present invention. FIGS. 3 and 4 show partially cut front views of the present invention cap and FIG. 5 shows the present invention cap without the overcap 21 in place. (Identicle parts shown in 1, 2, 3, 4 and 5 are identically numbered.) In FIG. 3, overcap 21 is shown fully screwed onto external threading 9 of first cap member 7 and second cap member 13 is in its downward, closed position. Arrow 10 illustrates the direction of rotation for removal of overcap 21. Threading 9 of first cap member 7 and threading 37 of overcap 21 are formed to cooperate such that when overcap 21 is fully threaded as shown, protrusion 29 is located clockwise just beyond cut-out 19 looking from above. Thus, when overcap is rotated in accordance with arrow 10, female threading 37 moves along male threading 9 to cause overcap 21 to lift upwardly and to cause protrusion 29 to slide along the underside of ledge 17 so as to lift second cap member 13 upwardly to open as shown in FIG. 4. Completion of unthreading will align protrusion 29 with cut-out 19 so that overcap 21 may be removed and second cap member 13 is positioned for dispensing as shown in FIG. 5. Protrusion 29 may have adequate downward flexibility to slip over ledge 17 when overcap 21 is moved downwardly but not sufficient flexibility to pass over ledge 17 when overcap 21 is moved upwardly. Alternatively, protrusion 29 may have adequate stiffness to not flex past ledge 17 in either direction and must pass through cut-out 19 for opening and closing.

Figure 6:
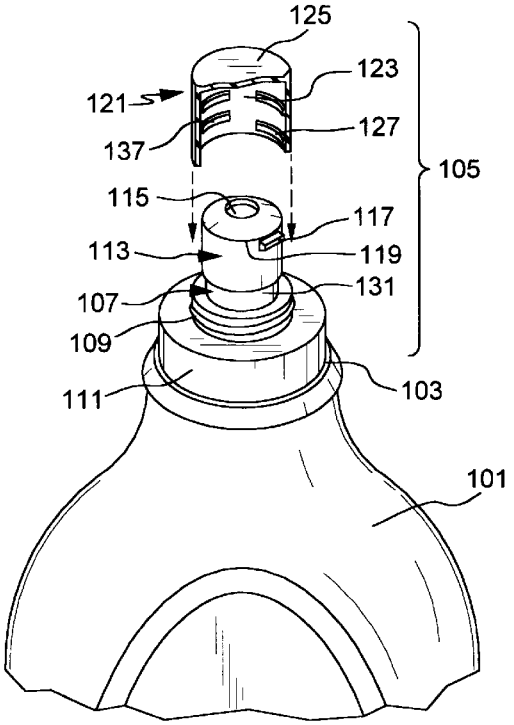
FIG. 6 shows a container with an alternative embodiment present invention cap with the ledge being on the inside of the overcap and the protrusion being on the outside of the second cap member; and, FIG. 7 shows a top view of an alternative embodiment second cap member with plural cut-outs.

FIG. 6 shows a front oblique view of a container 101 and a present invention cap shown generally as 105. Container 101 includes an open-necked top 103 which is adapted for attachment to a cap. In this case, the open-necked top 103 has snap-fit neck (not shown). Present invention cap 105 includes a first cap member 107 which has snap-fit locks located on the inside of base 11 for attachment to container 101 and also includes outside threading 109 for engagement with inside threading of overcap 121. First cap member 107 also has an upwardly projecting hollow portion 131 which includes a dispensing port which is typical of push-pull dispensing caps. Second cap member 113 is slidably attached to upwardly projecting hollow portion 131 of first cap member 107 so that it may reciprocally or cyclically be moved upwardly and downwardly from a first, downward closed position to a second, upward open position, but it is positioned on a vertical track to prevent circular rotation thereof relative to first cap member 107.

Second cap member 113 has a dispensing port 115 thereon which cooperates with the dispensing port of first cap member 107 such that when second cap member 113 is in the first, downward position it is closed, and when it is in the second, upward position, it is open.

Second cap member 113 also has a protrusion 117, as shown. Overcap 121 is adapted to cooperate with first cap member 107 and second cap member 113 so as to permit opening and closing of cap 105 without the user ever touching second cap member 113. Overcap 121 has a sidewall 123 and a top 125 as shown. Referring now to both FIGS. 1 and 2, it can be seen that overcap 121 has threading 137 which cooperates with external threading 109 of first cap member 107 and has a cut-out 119 located on the ridge 117 such that protrusion 117 cooperates with cut-out 119 of ridge 117 when overcap 121 is operated in an manner similar to the operation of overcap 21 discussed above. Note in this embodiment, however, the protrusion and cut-outs are in reversed positions as compared to cap 5 discussed above.

Figure 7:
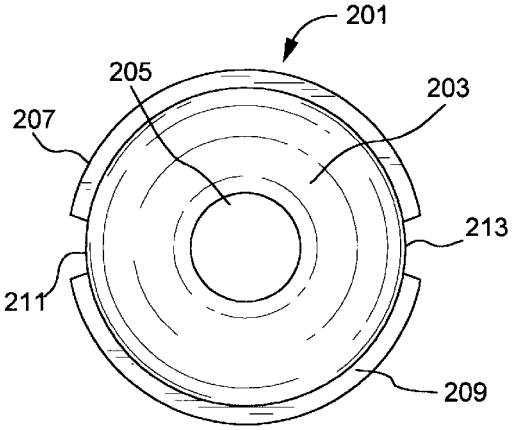
Figure 8:
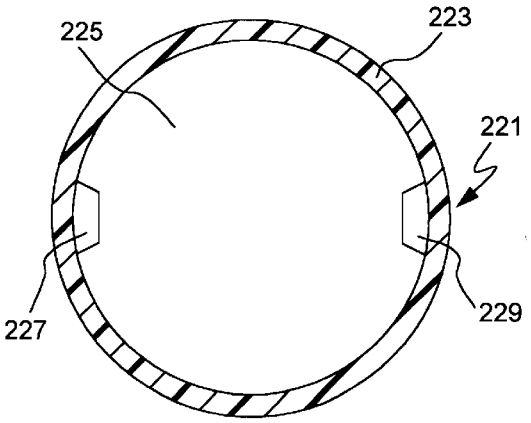
FIG. 8 shows a bottom cut view of an alternative embodiment present invention overcap with corresponding plural protrusions.

FIG. 7 shows a top view of second cap member 201 which is similar to second cap member 13 discussed above, but has a plurality of cut-outs. Thus, there is shown a top 203 with dispensing port 205 and ridges 207 and 209 separated by cut-outs 211 and 213. In FIG. 8 a bottom cut view of overcap 221 is shown. Here, overcap 221 has a sidewall 223 and a top 225 (threading is cut from the view). Sidewall 223 includes inwardly projecting protrusions 227 and 229, which cooperate and align with cut-outs 211 and 213 of second cap member 201 shown in FIG. 7. When second cap member 201 and overcap 221 are connected to a first cap member such as first cap member of FIG. 1, the first cap member threading 9 would be less than a half turn to correspond to the plural cut-outs and protrusions.

Obviously, numerous modifications and variations of the present invention are possible in light of the above teachings. It is therefore understood that within the scope of the appended claims, the invention may be practiced otherwise than as specifically described herein.

What is claimed is:

1. A push-pull dispensing cap for a container having an open-necked top, said dispensing cap and said container being adapted for connection to one another, which comprises:

(a) a first cap member having means for direct attachment to an open-necked container and having outside threading for engagement with threading of an overcap, and having an upwardly projecting hollow portion with at least one dispensing port and having means for slideably attaching a second cap member thereon such that said second cap member having a dispensing port may be cyclically moved upwardly and downwardly, with a first, closed position being a downward, closed position for non-dispensing, and a second, open position being an upward, open position for dispensing;

(b) said second cap member having an outwardly projecting ridge thereon with a cut-out located on said ridge to permit passage therethrough of a protrusion located inside an overcap, said second cap member being attached to said first cap member with means to prevent full horizontal rotation of said second cap member relative to said first cap member; and, (c) said overcap hollow and adapted to fit over said second cap member and having a top and a sidewall, and having internal threading adapted to thread with said outside threading of said first cap member, and having an internal protrusion on the inside of said sidewall of said overcap, said internal protrusion, said overcap threading and said first cap member threading being aligned relative to said cut-out of said second cap member, such that when said second cap member is in said first, closed position, said overcap may be screwed onto said threading of said first cap member whereby said protrusion will contact and flex past said ridge of said second cap member and will rest thereunder away from said cut-out of said second cap member, and such that when said second cap member is in said second, open position, said overcap may be screwed onto said threading of said first cap member, said protrusion pushes said second cap member from said second, open position to said first, closed position, and such that when said overcap is already screwed onto said threading of said first cap member and said second cap member is in said first, closed position and said overcap is unscrewed, said protrusion lifts said second cap member to said second, open position and then passes through said cut-out for removal.

2. The push-pull dispensing cap of claim 1 wherein second cap member is attached to said first cap member with means to prevent any horizontal rotation of said second cap member relative to said first cap member.

3. The push-pull dispensing cap of claim 1 wherein said threading is equal to or less than one full turn.

4. The push-pull dispensing cap of claim 1 wherein said first cap member includes an annulus dispensing port with a central stem and said second cap member has a top central dispensing orifice within which said stem fits to seal when said second cap member is in said first, closed position.

5. The push-pull dispensing cap of claim 1 wherein said first cap member means for direct attachment to an open-necked container is internal threading.

6. The push-pull dispensing cap of claim 1 wherein there are a plurality of protrusions and a plurality of corresponding cut-outs.

7. A push-pull dispensing cap for a container having an open-necked top, said dispensing cap and said container being adapted for connection to one another, which comprises:

(a) a first cap member having means for direct attachment to an open-necked container and having outside threading for engagement with threading of an overcap, and having an upwardly projecting hollow portion with at least one dispensing port and having means for slideably attaching a second cap member thereon such that said second cap member having a dispensing port may be cyclically moved upwardly and downwardly, with a first, closed position being a downward, closed position for non-dispensing, and a second, open position being an upward, open position for dispensing;

(b) said second cap member having a protrusion thereon for passage through a cut-out of an inwardly projecting ridge inside an overcap, said second cap member being attached to said first cap member with means to prevent full horizontal rotation of said second cap member relative to said first cap member; and, (c) said overcap hollow and adapted to fit over said second cap member and having a top and a sidewall, and having internal threading adapted to thread with said outside threading of said first cap member, and having an inwardly projecting ridge on the inside of said sidewall of said overcap with a cut-out located thereon, said cut-out threading and said first cap member threading being aligned relative to said protrusion of said second cap member, such that when said second cap member is in said first, closed position, said overcap may be screwed onto said threading of said first cap member whereby said ridge will contact said protrusion, said protrusion will flex, said ridge will pass thereunder and said protrusion will rest thereon away from said cut-out of said overcap, and such that when said second cap member is in said second, open position, said overcap may be screwed onto said threading of said first cap member, said ridge pushes said protrusion of second cap member and said second cap member itself from said second, open position to said first, closed position, and such that when said overcap is already screwed onto said threading of said first cap member and said second cap member is in said first, closed position and said overcap is unscrewed, said ridge lifts said protrusion and said second cap member to said second, open position and then said cut-out passes through said protrusion for removal.

8. The push-pull dispensing cap of claim 7 wherein second cap member is attached to said first cap member with means to prevent any horizontal rotation of said second cap member relative to said first cap member.

9. The push-pull dispensing cap of claim 7 wherein said threading is equal to or less than one full turn.

10. The push-pull dispensing cap of claim 7 wherein said first cap member includes an annulus dispensing port with a central stem and said second cap member has a top central dispensing orifice within which said stem fits to seal when said second cap member is in said first, closed position.

11. The push-pull dispensing cap of claim 7 wherein said first cap member means for direct attachment to an open necked container is internal threading.

12. The push-pull dispensing cap of claim 7 wherein there are plurality of protrusions and a plurality of corresponding cut-outs.

13. A push-pull dispensing cap for a container having an open necked top, said dispensing cap and said container being adapted for connection to one another, which comprises:

(a) a first cap member having means for direct attachment to an open necked container and having outside threading for engagement with threading of an overcap, and having an upwardly projecting hollow portion with at least one dispensing port and having means for slideably attaching a second cap member thereon such that said second cap member having a dispensing port may be cyclically moved upwardly and downwardly, with a first, closed position being downward, closed position for non-dispensing, and a second, open position being an upward, open position for dispensing;

(b) said second cap member being attached to said first cap member with means to prevent full horizontal rotation of said second cap member relative to said first cap member; and, (c) said overcap hollow and adapted to fit over said second cap member and having a top and a sidewall, and having internal threading adapted to thread with said outside threading of said first cap member;

wherein, one of said overcap and said second cap member having a protrusion projecting toward the other of said overcap and said second cap member, the other of said overcap and said second cap member having a ridge, such that when said second cap member is in said first, closed position, said overcap may be screwed onto said threading of said first cap member whereby said protrusion and ridge will contact one another, said protrusion will flex and said ridge and protrusion will pass one another, and such that when said second cap member is in said second, open position, said overcap may be screwed onto said threading of said first cap member, said protrusion and said ridge push against one another to move said second cap member from said second, open position to said first, closed position, and such that when said overcap is already screwed onto said threading of said first cap member and said second cap member is in said first, closed position and said overcap is unscrewed, said protrusion and said protrusion engage one another so that said overcap lifts said second cap member to said second, open position.

14. The push-pull dispensing cap of claim 13 wherein second cap member is attached to said first cap member with means to prevent any horizontal rotation of said second cap member relative to said first cap member.

15. The push-pull dispensing cap of claim 1 wherein said threading is equal or less than one full turn.

16. The push-pull dispensing cap of claim 13 wherein said first cap member includes an annulus dispensing port with a central stem and said second cap member has a top central dispensing orifice within which said stem fits to seal when said second cap member is in said first, closed position.

17. The push-pull dispensing cap of claim 13 wherein said first cap member means for direct attachment to an open necked container is internal threading.

18. The push-pull dispensing cap of claim 13 wherein there are a plurality of protrusions and a plurality of corresponding cut-outs.

* * * * *